US005433601A

United States Patent [19]

Buschulte et al.

[11] Patent Number: 5,433,601

[45] Date of Patent: Jul. 18, 1995

[54] DEPOSIT-FREE BURNER

[75] Inventors: Winfried Buschulte, Neuenstadt; Erich Adis, Hardthausen; Manfred Bader, Neuenstadt, all of Germany

[73] Assignee: Deutsche Forschungsanstalt fuer Luft- und Raumfahrt e.V., Bonn, Germany

[21] Appl. No.: 142,362

[22] PCT Filed: Mar. 19, 1993

[86] PCT No.: PCT/EP93/00668

§ 371 Date: Jan. 18, 1994

§ 102(e) Date: Jan. 18, 1984

[87] PCT Pub. No.: WO93/19326

PCT Pub. Date: Sep. 30, 1993

[30] Foreign Application Priority Data

Mar. 21, 1992 [DE] Germany ..... 42 09 220.5

[51] Int. Cl.[6] ..... F23Q 3/00

[52] U.S. Cl. ..... 431/265; 431/351

[58] Field of Search ..... 431/265, 351, 353

[56] References Cited

U.S. PATENT DOCUMENTS 3,720,496 3/1973 Briggs ..... 431/353
4,171,199 10/1979 Henriques ..... 431/265
4,427,367 1/1984 Yagisawa ..... 431/354
4,547,147 10/1985 Suzuki et al. ..... 431/265
4,629,414 12/1986 Buschulte et al. ..... 431/353

FOREIGN PATENT DOCUMENTS 175875 7/1985 European Pat. Off. .
363428 7/1962 Sweden .

*Primary Examiner*—Carroll B. Dority
*Attorney, Agent, or Firm*—Barry R. Lipsitz

[57] ABSTRACT

In order to improve a burner for generating hot gas comprising a burner pipe, a nozzle arranged in the burner pipe and having an outlet in its front face, a fuel jet exiting through the outlet, a shield arranged near the nozzle for subdividing the burner pipe into a precombustion chamber located upstream and accommodating the nozzle and a combustion chamber located downstream, a central passage arranged in the shield for the fuel jet exiting from the outlet and a plurality of openings surrounding the passage in the shield, combustion air passing through the openings from the precombustion chamber into the combustion chamber such that deposits are no longer formed therein, it is suggested that an air gap is provided between the shield and the nozzle, combustion air passing through the air gap from the precombustion chamber through the passage into the combustion chamber, and that a rim of the passage is provided with a flow disruption edge for the combustion air passing through the air gap.

10 Claims, 1 Drawing Sheet

DEPOSIT-FREE BURNER

The invention relates to a burner for generating hot gas comprising a burner pipe, a nozzle arranged in the burner pipe and having an outlet in its front face, a fuel jet exiting through the outlet, a shield arranged near the nozzle for subdividing the burner pipe into a precombustion chamber located upstream and accommodating the nozzle and a combustion chamber located downstream, a central passage arranged in the shield for the fuel jet exiting from the outlet and a plurality of openings surrounding the passage in the shield, combustion air passing through the openings from the precombustion chamber into the combustion chamber.

Burners of this type are known, for example, from EP-A-0 175 875.

The disadvantage of these burners is in the fact that a heat contact exists between the nozzle and the front face of the nozzle so that the nozzle is warmed up by the hot shield and, in particular, after the burner has been switched off, the oil cracks outside the nozzle or also in the interior of the nozzle and forms clogging soot deposits and/or oil carbon deposits on the nozzle ducts or on the outlet of the nozzle so that the burner becomes inoperable.

Thus, the object of the invention is to improve a burner of the generic type such that deposits are no longer formed therein.

This object is accomplished in accordance with the invention, in a burner of the type described at the outset, in that an air gap is provided between the shield and the nozzle for combustion air to pass through the air gap from the precombustion chamber through the passage and into the combustion chamber, and that a rim of the passage is provided with a flow disruption edge for the combustion air flowing through the air gap.

By means of the solution according to the invention, on the one hand, a thermal contact is eliminated between the heated shield and the nozzle, in particular, the front face of the nozzle and, in addition, it is ensured by the flow disruption edge that the air flowing through the passage frees the air gap, on the one hand, and the passage itself, on the other hand, from adhering deposits.

It is particularly favourable when the passage is provided with wall surfaces extending conically in the direction of the combustion chamber, since such a design of the wall surfaces prevents an interference of the fuel jet, particularly, of the spray cone formed by the fuel jet.

With respect to the position of the flow disruption edge, no further details have been given as yet. In fact, it has proven to be particularly advantageous for the flow disruption edge to be located on the side of the conically extending wall surfaces facing the front facr of the nozzl, so that the flow distruption edge represents the narrowest point of the opening.

Particularly expedient conditions result when the flow disruption edge lies in a plane which extends vertically to an axis of the nozzle.

In addition to this, the air gap and the effect of the flow disruption edge can be optimally designed when an annular surface adjoins the flow disruption edge on the upstream side of the shield in radial direction to the passage, i.e. in particular, to the axis of the nozzle.

It is particularly advantageous when the annular surface is plane and extends essentially at right angles to axis of the nozzle.

This is realized in a particularly easy, constructive manner when the plane annular surface lies essentially in a plane which is defined by the upstream surface of the shield.

The air gap is realized in a particularly easy manner in one of the embodiments described above, when a front side of the front face of the nozzle is arranged upstream at a distance from the flow disruption edge in axial direction of the nozzle. In this case, it is ensured that even a slight leakage of oil from the front face of the nozzle will not lead to a conglutination in the area of the flow disruption edge.

Moreover, it is a further advantage when the front face of the nozzle is arranged upstream at a distance from the annular surface in axial direction to the nozzle, so that the air gap is formed between the annular surface and the front face of the nozzle.

With respect to the dimensioning of the central passage, no details have been specified as yet. Thus, it has proven to be favourable, within the scope of the invention, when the central passage has in the area of the flow disruption edge a diameter which is approximately the same size as the diameter of the front face of the nozzle.

A particularly expedient dimensioning of the inventive solution results when the diameter of the flow disruption edge is smaller than or the same as the diameter of the front face of the nozzle.

Further features and advantages of the invention are the subject matter of the following description as well as the illustrated representation of an embodiment.

The invention concerns the most varied oil burners and is discussed in the following using a so-called blue burner as example, i.e., a burner in which oil is burnt completely with a blue flame. The invention is, however, not limited to such blue burners, for example, the advantage according to the invention can also be achieved with the described constructive measures using yellow burners.

Figure 1:
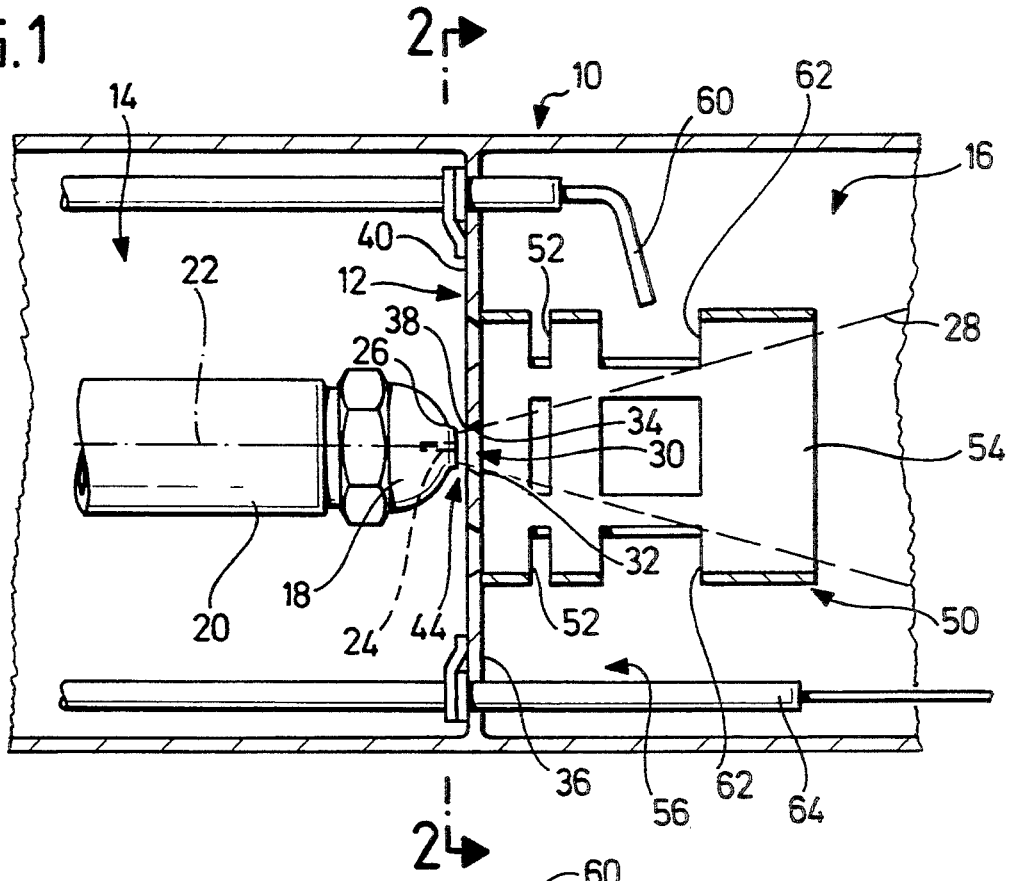
FIG. 1 shows a longitudinal section through the embodiment.

The burner represented in FIGS. 1 and 2 comprises a cylindrical burner pipe 10 which is subdivided by means of a wall, hereinafter designated as shield 12, into a precombustion chamber 14 located upstream and a combustion chamber 16 located downstream.

In the precombustion chamber 14 a nozzle 18, which is connected with a fuel supply line 20, is arranged coaxially to the burner pipe 10. This nozzle 18 is provided with an outlet 24 which is arranged coaxially to its axis 22 and in a front face 26 of the nozzle 18.

A fuel jet 28 exits from this outlet 24 and passes through a central passage 30 in the shield 12 and enters the combustion chamber 16. The central passage 30 is, thereby, arranged coaxially to the axis 22 of the nozzle 18 and has conically designed edge surfaces 32 which extend from a flow disruption edge 34 up to a surface 36 of the shield located downstream. The flow disruption edge 34 is surrounded by a plane annular surface 38 upstream of the conical outer surfaces, the annular surface extending essentially at right angles to the axis 22 and preferably lies in one plane with the surface 40 of the shield 12 located upstream.

The nozzle 18 is arranged with its front face 26 upstream at a distance from the annular surface 38 in the direction of the axis 22 and is preferably aligned parallel to the plane in which the annular surface 38 is located, that means, at right angles to the axis 22.

Thus, an air gap 44 results between the annular surface 38 and the front face 26 of the nozzle, combustion air passing through this air gap to join the fuel jet 28 and flows together with this fuel jet through the passage 30.

The flow disruption edge 34 forms the narrowest point of the passage 30 and preferably has a diameter which is approximately equal to the diameter of the front face 26 of the nozzle or is smaller than the same.

In the solution according to the invention, the nozzle 18 is, thus, separated from the heated shield 12 by the air gap 44 and, in addition, the flow disruption edge 34 of the passage 30 leads to the fact that even when particles are deposited in the area of the passage 30, these are loosened when operating the burner, so that the air gap 44 does not get blocked and also the passage 30 always remains free of soot and oil carbon deposits even during longer operation.

A mixing tube 50, preferably, adjoins the shield 12 downstream, the mixing tube forming a connection via peripheral slots 52 directly following the shield 12 between its interior space 54 forming the mixing chamber and an annular space serving as recirculation chamber 56 which concentrically encircles the mixing tube 50.

An ignition means 60 is guided from the precombustion chamber 14 through the shield 12 and ends in the area of a window 62 in the mixing tube 50, so that an ignition can take place in this area.

In a similar manner, a measuring probe 64 is guided from the precombustion chamber 14 through the shield 12 and into the combustion chamber 16.

Figure 2:
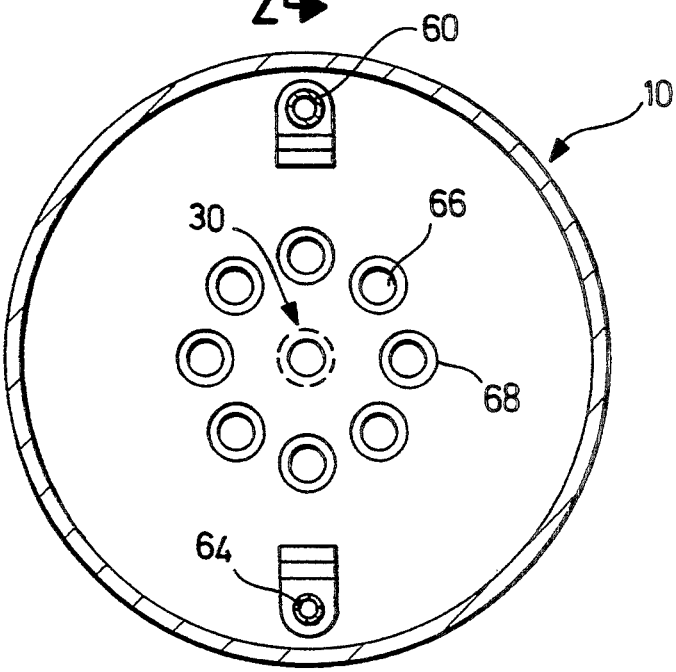
FIG. 2 shows a section along line 2—2 in FIG. 1.

As represented in FIG. 2, in particular, a plurality of openings 66 each having a circular cross section, are arranged in a circle surrounding the central passage 30 which form a connection between the precombustion chamber 14 and the interior space 54 surrounded by the mixing tube 50 in the combustion chamber 16. The openings preferably lie within a surface, which results from the projection of the inside cross-sectional area of the mixing tube onto the shield 12. Further, the openings 66 are preferably arranged such that the openings 66 are bevelled on the side of the shield 12 facing the precombustion chamber 14 and preferably narrow conically in a downstream direction.

We claim:

1. A burner for generating hot gas comprising:

a burner pipe;

a shield for subdividing said burner pipe into a precombustion chamber located upstream and a combustion chamber located downstream;

a nozzle in said precombustion chamber near said shield, said nozzle having a front face and an outlet therein for fuel to jet therefrom;

a passage in said shield for the flow therethrough of fuel from said nozzle outlet, said passage having an interior wall surface extending conically and divergently in the direction of the combustion chamber;

a plurality of openings surrounding said passage in said shield for combustion air to pass from the precombustion chamber into the combustion chamber;

a flow disruption edge in said passage in said shield;

a small gap between said shield and said nozzle for an amount of air to pass therethrough into said passage in said shield with disruption by said flow disruption edge, whereby said gap and said passage are maintained free of adhering deposits of soot and oil carbon by said flow of air therethrough.

2. A burner according to claim 1 characterized in that the flow disruption edge is located on the side of the conically extending wall surfaces facing the front face of the nozzle.

3. A burner according to claim 1, characterized in that the flow disruption edge is in a plane extending vertically to an axis of the nozzle.

4. A burner according to claim 1, characterized in that an annular surface adjoins the flow disruption edge on the upstream side of the shield in a radial direction to the passage, which in conjunction with said front face of said nozzle forms said gap between said shield and said nozzle.

5. A burner according to claim 4, characterized in that the annular surface is plane and extends at right angles to the axis of the nozzle.

6. A burner according to claim 5, characterized in that the plane annular surface lies essentially in the plane defined by the upstream surface of the shield.

7. A burner according to claim 1, characterized in that the front face of the nozzle is arranged upstream at a distance from the flow disruption edge in an axial direction of the nozzle.

8. A burner according to claim 7, characterized in that the front face of the nozzle is arranged upstream at a distance from the annular surface in an axial direction of the nozzle.

9. A burner according to claim 1, characterized in that the passage has in the area of the flow disruption edge a diameter approximately the same size as the diameter of the front face of the nozzle.

10. A burner according to claim 1, characterized in that the diameter of the flow disruption edge is smaller than or the same as the diameter of the front face of the nozzle.

* * * * *